United States Patent [19]

Herdzina et al.

[11] Patent Number: 4,854,799

[45] Date of Patent: Aug. 8, 1989

[54] DUAL LANE CONVERSION SYSTEM

[75] Inventors: Frank J. Herdzina, Schaumburg; Rollie M. Goodrich, Palatine, both of Ill.

[73] Assignee: Service Tool Die & Mfg. Co., Elk Grove Village, Ill.

[21] Appl. No.: 254,142

[22] Filed: Oct. 6, 1988

Related U.S. Application Data

[62] Division of Ser. No. 143,585, Jan. 13, 1988.

[51] Int. Cl.[4] ..... B21D 51/44

[52] U.S. Cl. ..... 413/66; 413/12; 413/64

[58] Field of Search ..... 413/62, 64, 66, 12, 413/14, 56; 72/405, 421, 456

[56] References Cited

U.S. PATENT DOCUMENTS 4,568,230 2/1986 Brown ..... 413/66

4,723,882 2/1988 Wissman et al. ..... 413/14

*Primary Examiner*—Frederick R. Schmidt

*Assistant Examiner*—Robert Showalter

*Attorney, Agent, or Firm*—Kinzer, Plyer, Dorn, McEachran & Jambor

[57] ABSTRACT

A press for converting work pieces into finished parts has an elongated bolster mounted on a press bed. The bolster supports columns on which a ram is slidable. The bolster also supports the lower die shoe of the press tooling. A conveyor or transfer system mounted on the bolster carries work pieces into and out of the area of the tooling. The bolster is a unitary piece which integrates support of the die shoe, columns and conveyor to assure proper cooperation and alignment among them. A pivotable carrier mounts a feed mechanism for feeding a stock strip into the tooling. Power to the feed mechanism is supplied through a shaft which is coaxial with the hinge line of the carrier, so that the carrier can be swung away from the tooling for service access without requiring disconnection of the power supply. A traveling vacuum box on the lower die shoe supports the conveyor for vertical as well as longitudinal motion, and retains the work pieces on the conveyor.

2 Claims, 8 Drawing Sheets

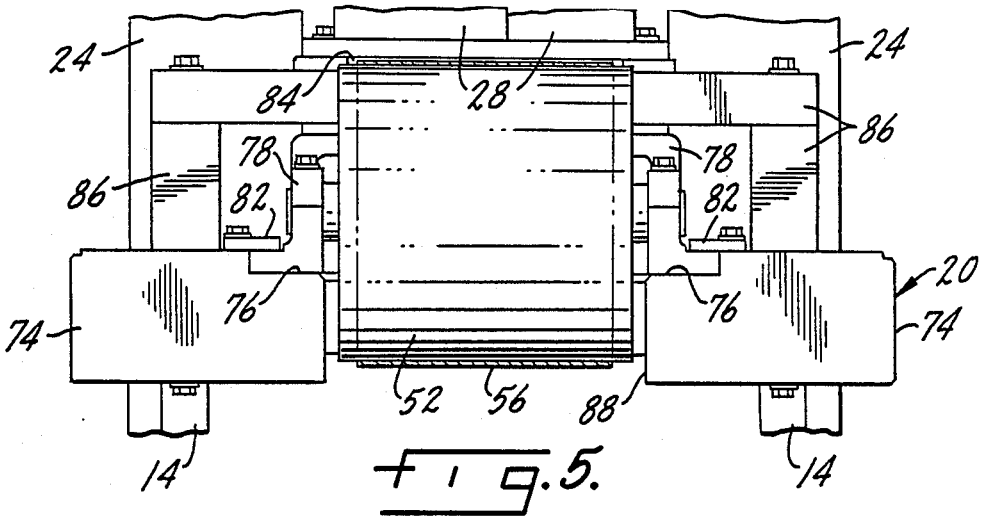
Fig. 5.
Fig. 6.
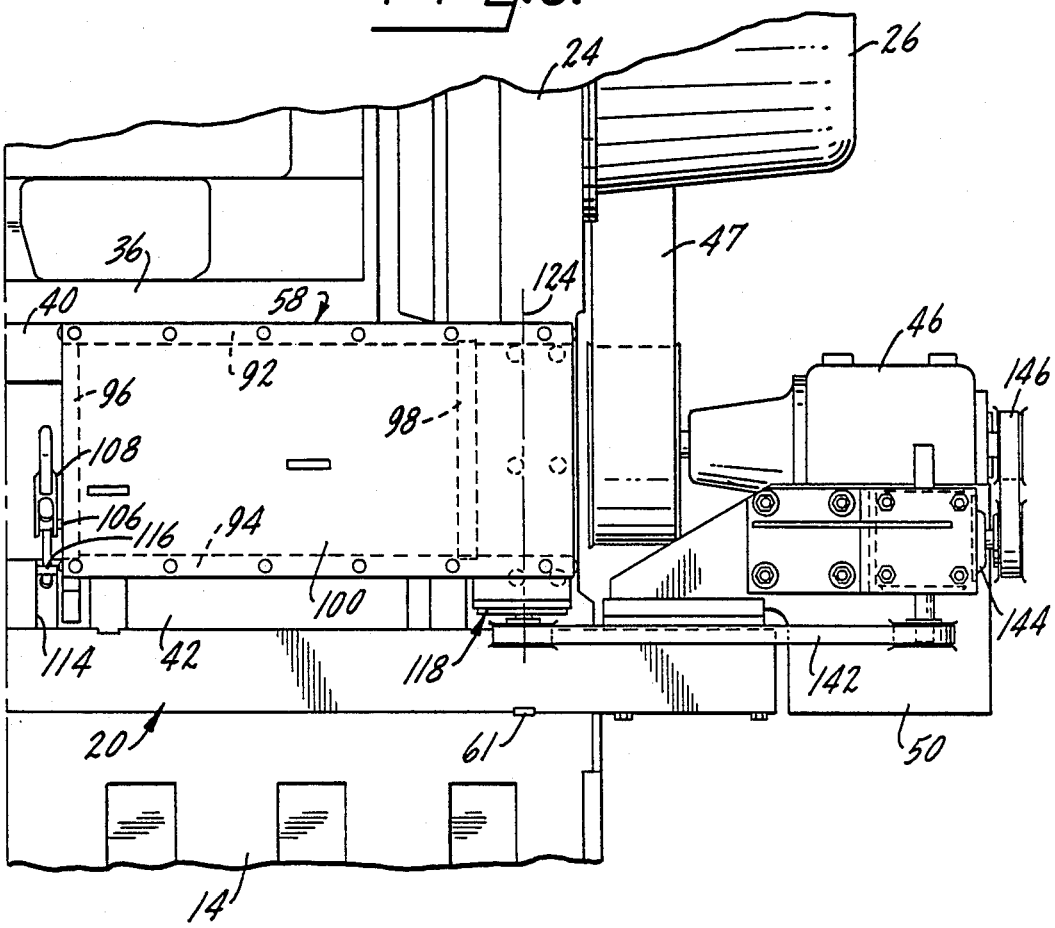

DUAL LANE CONVERSION SYSTEM

This is a divisional of co-pending application Ser. No. 143,585 filed on Jan. 13, 1988.

BACKGROUND OF THE INVENTION

This invention relates to dual lane conversion systems particularly adapted for conversion systems making easy-open can ends, although it will be understood that it could apply to presses manufacturing other types of parts.

Presses for converting ends for cans and the like are known. Presses of this general type are available from the Minster Machine Company of Minster, Ohio. U.S. Pat. No. 4,568,230 shows a general layout of a press for processing work pieces or shells into finished can ends with an opening tab attached thereto.

The presses used for the manufacture of easy-open can ends generally comprise a press bed mounted on legs which rest on the floor. Four columns or uprights or pillars are mounted on the press bed. The columns support a crown in which a main drive for the various press components is mounted. The columns also have slides or ways attached thereto for supporting a reciprocating ram. The ram carries upper tooling, which cooperates with lower tooling on the bed. The tooling defines a plurality of stations in which the shells are progressively converted into easy-open can ends. A conveyor carries the shells into and through the stations of the die tooling. The shells merely rest in openings in the conveyor. They are held in place by a vacuum box placed generally underneath the forward run of the conveyor at the area of the tooling.

The tabs are formed by tab tooling, which is supplied with strip stock by a stock feed mechanism. The tab tooling forms a tab and separates it from the strip stock, and attaches it to a can end.

While presses as generally described above are known, there remain several difficulties associated with the setup, operation and maintenance of the presses, which reduce productivity. First, it can be appreciated that the various moving parts of the press must be precisely aligned to assure production of high quality parts. Most obviously, the upper tooling which reciprocates on the ram must be precisely in alignment with the stationary lower tooling. This requires that the ram and, therefore, the columns be precisely located. Similarly, the conveyor or transfer system must cooperate with the tooling to place the work pieces or shells in the proper place for conversion by the tooling. Operation of the conveyor system is complicated by the fact that the shells must be indexed through the stations of the die tooling not only longitudinally, but also in a vertical direction to accommodate the reciprocating motion of the upper tooling. Location of the tab stock feeder mechanism further complicates the alignment problems encountered in setting up the machine.

The second difficulty with prior art presses was just eluded to, namely, the need to maintain registration of the shells as they move from one station to the next. While it is known to use a vacuum box to keep the shells from flying off the conveyor entirely, prior art vacuum boxes make no provision for the vertical motion of the upper tooling. That is, in order to move the shells longitudinally from station to station, they must be spaced from the upper and lower tooling during indexing. However, during a downstroke of the ram the shells must come into contact with the tooling in order for it to perform conversion operations. In prior vacuum boxes this vertical motion results simply by allowing flexure of the conveyor belt under the influence of the upper tools driving the shells and conveyor belt downwardly. This can lead to loss of registration of the shells on the conveyor.

A third difficulty of prior press designs is the down time caused by inconvenient access to the tooling. A primary reason for poor service access is the necessary location of the tab stock feeder mechanism adjacent or opposite the tooling. Thus, only one side of the tooling is accessible for maintenance purposes. While the tab stock feeder mechanism can be disassembled for access to the tooling, such a process is time consuming and inconvenient. The machine and its timing must be totally set up again, because once the tab stock feeder is disconnected from the drive, the necessary timing is lost.

SUMMARY OF THE INVENTION

The present invention addresses each of the three difficulties enumerated above. The alignment and registration problems during setup are resolved by the present invention. This is done by providing a unitary, elongated bolster which fits between the press bed and the columns. That is, the columns rest on the bolster rather than on the press bed. Also, the die shoe of the lower tooling is located and affixed to the bolster. Similarly, the conveyor or transfer system is mounted on the bolster. The bolster has locators or keys formed therein, which cooperate with similar alignment keys on the lower die shoe, the columns, and the conveyor system. This arrangement assures precise locations of all of these cooperating parts of the press. Keys are provided to locate the columns both longitudinally and laterally of the bolster. Thus, the bolster integrates support of the press elements.

Registration of the shells on the conveyor is maintained by a traveling vacuum box. The vacuum box has a case mounted on the lower die shoe, and a frame which is vertically slidable within the case. The frame has edge tracks which engage the lateral edges of the conveyor as it moves through the vacuum box. It also includes a central guide. Flanges on the tracks and guide overlie the upper surface of the conveyor such that the edges of the shells are trapped against vertical separation from the conveyor. Thus, the shells are positively retained in position on the conveyor, in addition to the vacuum retention.

The frame is mounted on spring supports, and there are actuators depending from the upper die shoe on the ram. These actuators are also spring loaded with springs that are stronger than those of the frame supports. The actuators are sized to contact the frame prior to the ram reaching the bottom of its downstroke. This pushes the frame downwardly, and carries the shells into contact with the lower tooling. When the frame bottoms out, the springs of the actuators compress, providing a lost motion which allows the ram to reach bottom dead center without damaging the vacuum box. On the upstroke of the ram, the actuators will hold the frame in its down position until the upper tools have moved out of contact with the shells. Once that occurs, the frame will move back up to its raised position under the influence of the frame supports. This raises the shells off of the lower tooling where they are ready for indexing to the next station.

Access to the tooling is facilitated by a hinged tab stock feeder mechanism. The feeders are located within a carrier which is mounted on one of the columns. The carrier is pivotable away from the tooling about a hinge line. Mechanical power is supplied from the main drive to the feeders through a drive shaft which is coaxial with the hinge line. This permits pivoting motion of the carrier without disconnecting the drive. Consequently, the timing between the feeder and the other parts of the press is not lost when the feeder carrier is pivoted to its service position.

BRIEF DESCRIPTION OF THE DRAWINGS

FIG. 5 is an end elevation view of the bolster looking from the right end of FIG. 4.

FIG. 6 is an elevation view of the tab stock feeder mechanism, the direction of line 6—6 of FIG. 2.

DETAILED DESCRIPTION OF THE INVENTION

Figures 1, 2:
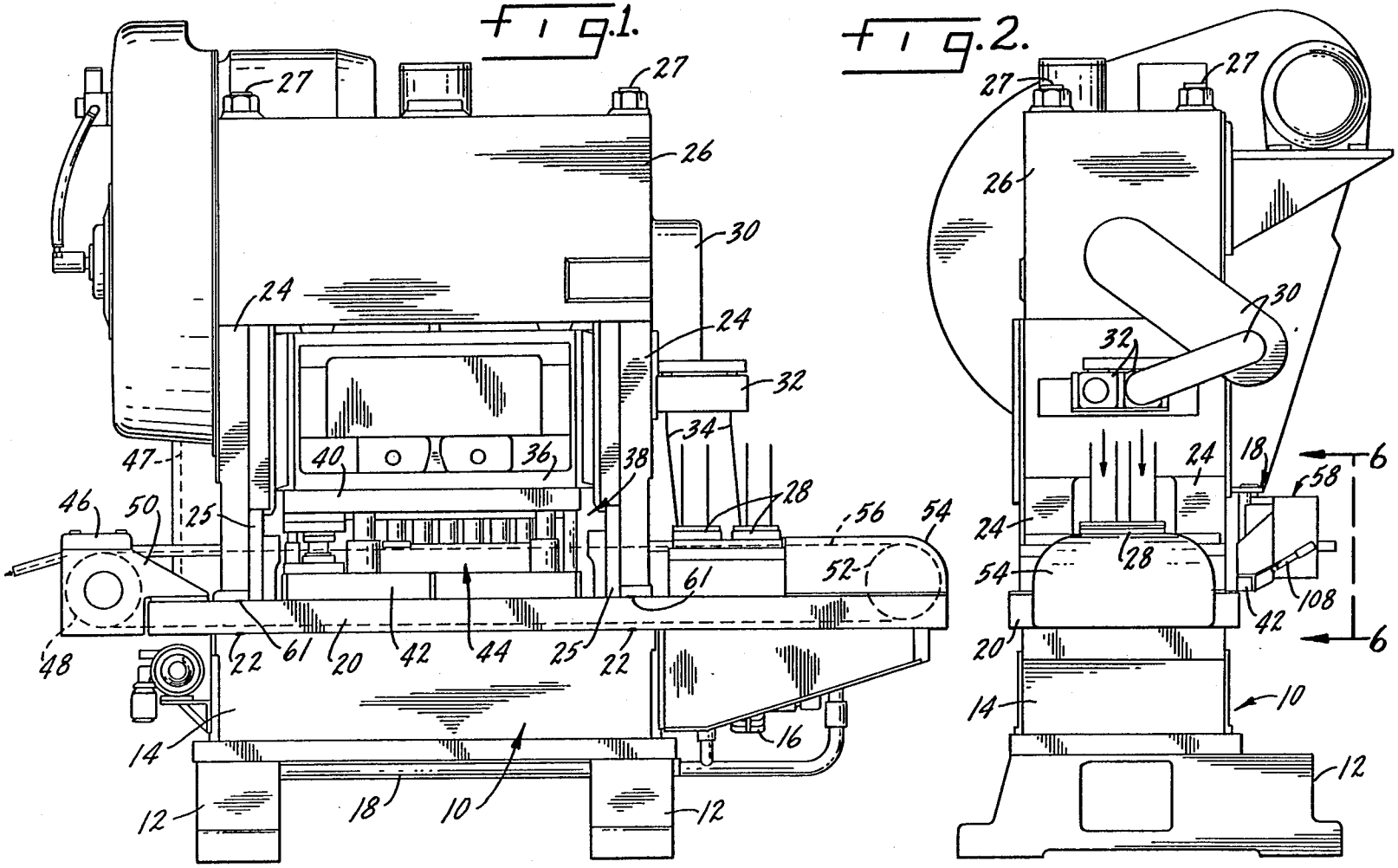
FIG. 1 is a front elevation view of the conversion system of the present invention.
FIG. 2 is an end elevation view of the conversion system, looking from the right side of FIG. 1.

The conversion system or press is shown generally at 10 in FIGS. 1 and 2. For purposes of description, the portion of the press shown in FIG. 1 will be termed the front of the machine. The right hand side as seen in FIG. 1 will be called the input side with the left hand side referred to as the output side. The side not shown in FIG. 1 will be denoted the back of the machine. The press includes a pair of legs 12 supporting a press bed 14. Certain auxiliary equipment such as a vacuum pump 16, and a vacuum manifold 18 may be attached to the press bed.

A unitary bolster 20 rests on top of the press bed 14, and is keyed thereto as at 22. It will be noted that the bolster 20 extends beyond the edges of the bed 14. Details of the inventive bolster will be described below.

Four columns or uprights 24 are mounted on top of the bolster 20. Each column includes a way or track 25. A crown 26 is supported on top of the columns 24. The bed 14, bolster 20, columns 24 and crown 26 ar fastened together by tie rods 27 extending through these components. Inside the crown is a main drive means, including a motor, crankshaft, and flywheel (not shown). The various components of the press are driven by means of mechanical connections to the crankshaft. For example, rotary down stackers 28 which place shells onto a conveyor are driven by belts connected to the crankshaft. The housings for the belts are shown at 30. They are connected to gear boxes 32. Drive shafts shown schematically at 34 connect the gear boxes 32 to the down stackers.

A ram 36 is slidable on the ways 25. It is driven by the crankshaft in a reciprocating motion. Tooling shown generally at 38 is located between the ram 36, and the bolster 20. The tooling shown is lane and tab tooling for converting can ends. This tooling comprises the usual dies and punches required to form the ends. As is customary, the tooling is divided into upper and lower sets, including an upper die shoe 40, and a lower die shoe 42. The upper shoe 40 is affixed to the ram 36, and moves therewith. The lower die shoe is keyed to the bolster 20, as described below. The usual die fixtures and punch holders are mounted on the die shoes. A traveling vacuum box is indicated schematically at 44.

Figure 4:
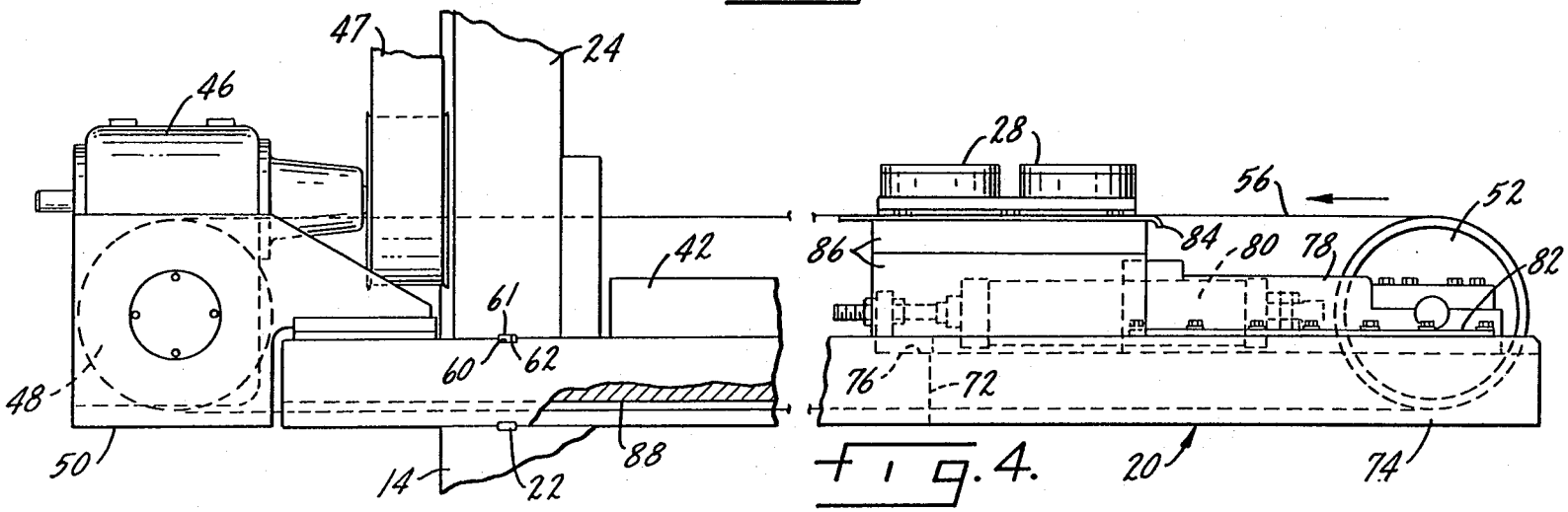
FIG. 4 is an enlarged front elevation view of the bolster, with portions omitted, showing the conveyor system mounted thereon.

The press includes a transfer or conveyor system, including a main gear box 46 driven from the crankshaft by belt 47 (seen in FIG. 4). The gear box 46 drives a head end pulley 48, which is mounted for rotation on a pair of brackets 50. The brackets are attached to the bolster. A tail end pulley 52 is mounted at the other of the bolster. It is covered by a shroud 54. An endless conveyor belt illustrated schematically at 56 is driven by the pulley 48, and revolves about pulley 52. The belt 56 has openings 57 for receiving shells.

A strip stock feeder shown generally at 58 is mounted at the back of the press, opposite the area of the tooling. This apparatus feeds a strip stock material which, in the embodiment shown, is used to make the tab parts of the can ends. Details of the stock feed mechanism 58 will be described below.

Figure 3:
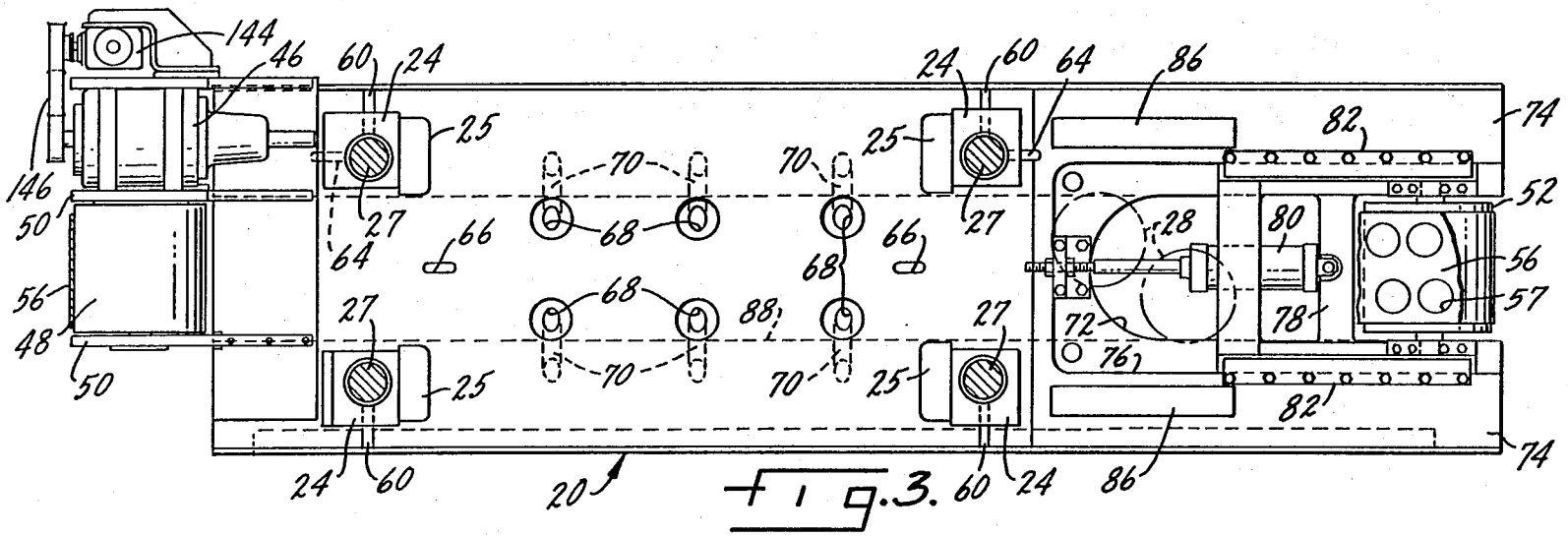
FIG. 3 is a top plan view of the bolster with the lower die shoe omitted for clarity.

Turning now to FIGS. 3-5, details of the bolster 20 and the conveyor system are shown. The bolster is an elongated slab of steel, approximately 6 inches thick. The upper surface of the bolster has a plurality of locating means in the form of keyways for establishing the positions of components mounted on the bolster, namely, the columns 24 and lower die shoe 42. There is a lateral keyway 60 for each of the columns, which is aligned with a matching keyway 62 (FIG. 4) on the bottom of the columns to precisely set the position of the columns along the length of the bolster. A key 61 fits into the matching keyways. The two columns at the rear of the bolster also have longitudinal keyways 64 (FIG. 3). These keys fix the lateral position of the rear two columns. Central keyways 66 establish the center line of the bolster. They are used to fix the lower die shoe 42 in position. They also establish a reference line for drilling the bolt holes used to mount the brackets 50. The keyways 60 and 64 are machined into the bolster with reference to the central keyways.

The bolster has vacuum supply ports 68 in communication with passages 70, which extend through the bolster. Passages 70 are connected to the vacuum manifold 18 through mating passages in the bed 14.

The input end of the bolster has a U-shaped cutout shown at 72. The cutout forms a pair of arms 74. The U-shaped cutout 72 accommodates the tail end pulley 52 between the arms 74. Immediately adjacent the cutout, on the upper surface of the bolster is a depression 76. A saddle 78 fits in the depression 76, and carries the bearings for mounting the tail end pulley 52. A cylinder 80 is mounted between the bolster and the saddle 78 for adjusting the longitudinal position of the saddle, thereby controlling the tension on the conveyor belt 56. A pair of restraining bars 82 are fixed to the bolster arms 74 to hold the saddle in the depression 76.

The conveyor belt 56 is supported on its forward run adjacent the tail end pulley 52 by a plate 84. The plate is mounted on a bridge structure 86 attached to the bolster. The bridge 86 also supports the down stackers 28.

From the plate 84 the forward run of the conveyor progresses between two of the columns 24, and then into the area of the tooling. The forward run of the conveyor is supported in the tooling area by the vacuum box 44, as will be described in detail below. Upon leaving the tooling area, the forward run of the conveyor proceeds between the two output side columns to an output device where the finished can ends are discharged. The conveyor belt winds around the head end or drive pulley 48 to begin the return run. The return run is accommodated by a channel 88 cut in the underside of the bolster as shown in FIG. 4.

The bolster 20 provides an integrated support member for the various press components. In the embodiment shown the bolster extends beyond the columns to provide support for the transfer system or conveyor. The bolster also assures proper alignment of the components mounted thereon.

Looking now at FIGS. 6–10, the stock feed mechanism 58 is shown in detail. Although it could be used to feed any type of work pieces or stock, in the illustrated embodiment it is used to feed the tab stock strip, so hereinafter the stock feeder will be referred to as the tab feeder. Since the feeder is supplying the tab stock to the tab tooling, it is located opposite or adjacent to the tab tooling, on the rear side of the machine. Thus, the tab stock is fed transversely to the direction of the main conveyor belt. As a result of this required positioning for the feeder, it blocks service access to the tooling. The present invention alleviates this difficulty by pivotally mounting the tab feeder 58 to one of the columns 24. The feeder pivots about a hinge line from its normal working position to a service position shown in phantom at 90 in FIG. 7.

The feeder components are mounted on a carrier comprising top and bottom plates 92 and 94, and first and second side plates 96 and 98. A removable cover 100 encloses the carrier on three sides.

The feeder carrier is pivotally mounted by a bracket 118, which is bolted to a column 24. The bracket includes a stiffener 120, and upper and lower extensions 122. The extensions mount bearings about which the top and bottom plates are pivotable. These bearings define a hinge line or rotational axis 124.

The first side plate 96 carries a pair of locating pads 102 and 104 (FIG. 10), which define horizontal and vertical locating surfaces, respectively. The first side plate also has a pin 106, on which a latch 108 is pivotally mounted.

The rear edge of the lower die shoe 42 has milled surfaces 110 and 112. When the feeder is in the closed or operating position, the pads 102 and 104 of the first end plate engage these milled surfaces to locate the carrier in the correct position with respect to the die shoe. Immediately adjacent these milled surfaces is a slot 114 into which a hook portion of the latch 108 fits to engage a removable bolt 116 for holding the feeder in the closed position.

The actual apparatus for feeding the tab stock is conventional, and may be purchased from Fergurson Manufacturing of St. Louis, Mo. Briefly, that mechanism includes a right angle gear box 126 having a shaft 128, which is coaxial with the hinge line 124. Gear box 126 drives a belt 130 about an adjustable idler 132, which is mounted on the second side plate 98. The side plate has a U-shaped cutout 134 permitting passage of the belt and idler. The belt 130 drives a stock input device 136 and a stock output device 138. The stock itself is shown diagrammatically at 140 in FIG. 7. It will be understood that associated equipment, such as lube units and a scrap chopper have been omitted or only partially shown.

Figure 7:
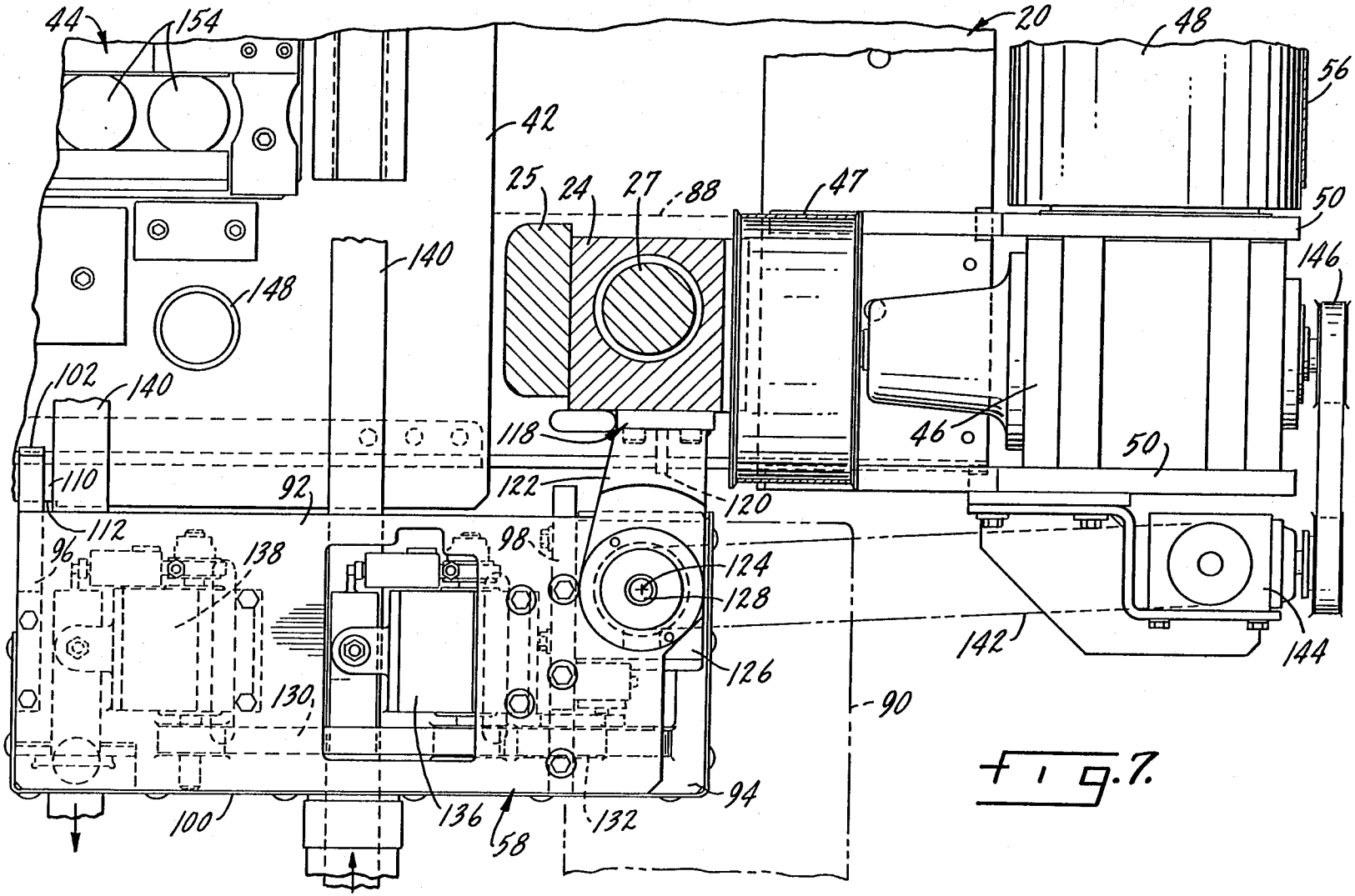
FIG. 7 is a plan view of the tab stock feeder mechanism.
Figure 8:
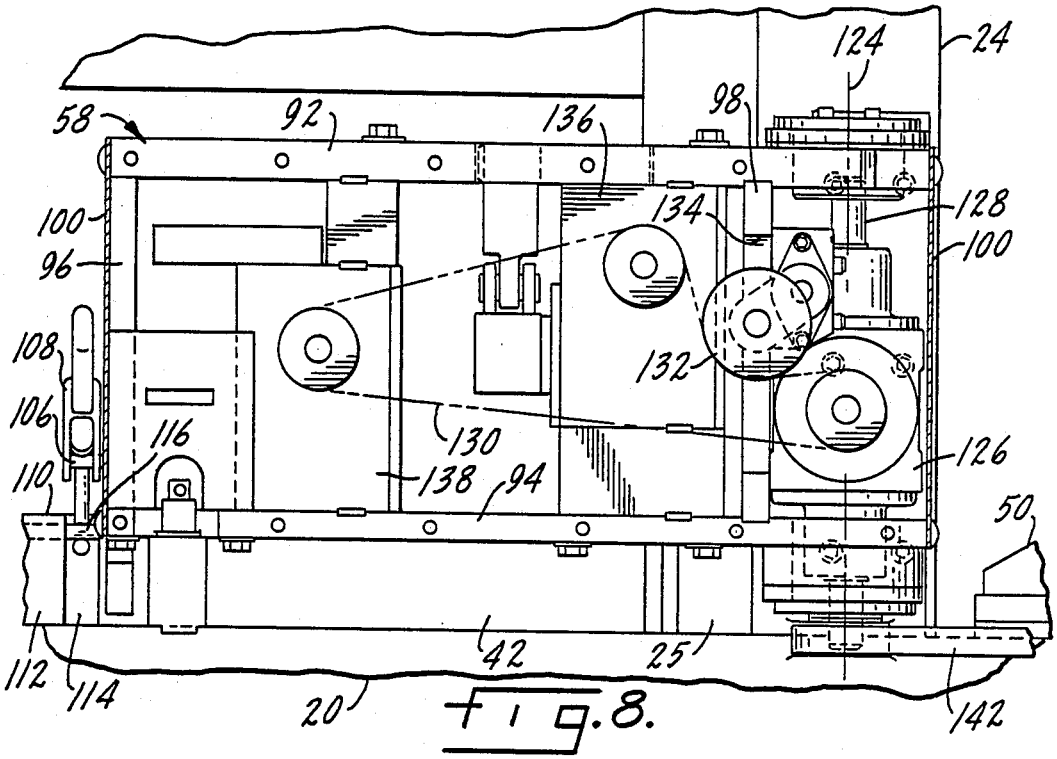
FIG. 8 is an enlarged front elevation view of the tab feeder, with the cover omitted.
Figure 9:
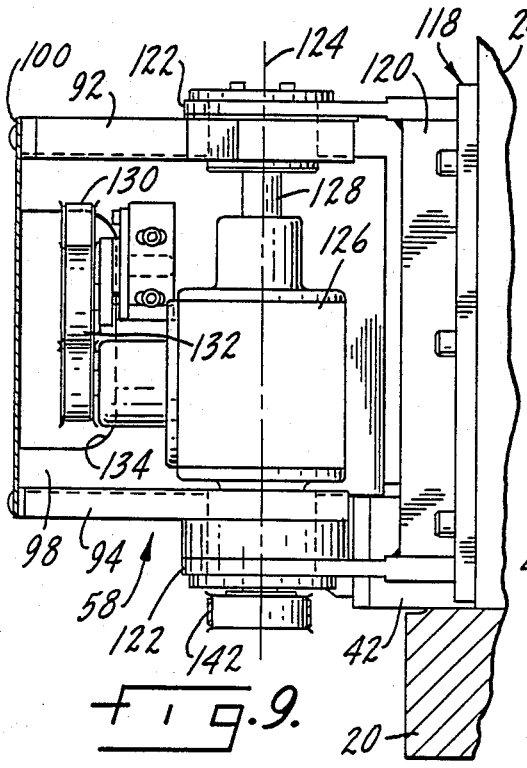
FIG. 9 is a side elevation view of the tab stock feeder, looking from the right side of FIG. 8.
Figure 10:
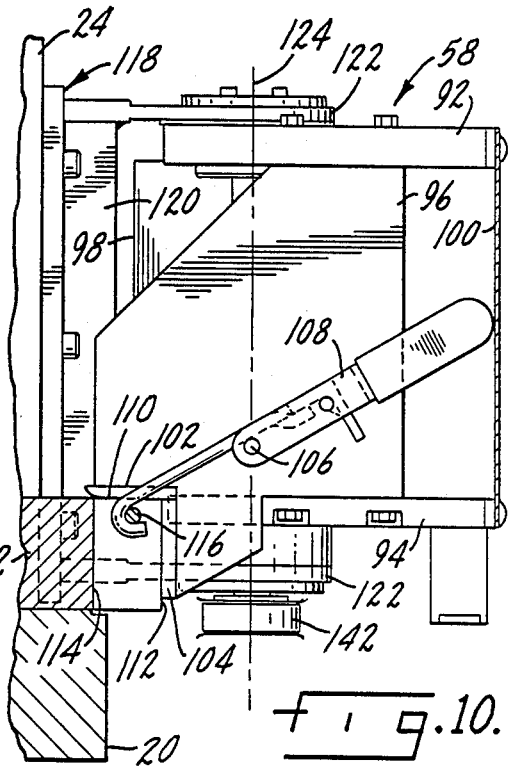
FIG. 10 is a side elevation view of the tab stock feeder, looking from the left side of FIG. 8.

Mechanical power to the gear box 126 is provided through a belt 142, driven by a right angle drive 144 (FIGS. 6 and 7). This drive in turn receives power from belt 146, which engages an output shaft of the main gear box 46.

It can be seen that with this drive arrangement the carrier can be rotated about the hinge line 124 without the need for disconnecting any of the belts. The timing of the feeders is not lost when the carrier pivots between operating and service positions. The locating surfaces on pads 102 and 104 assure that the carrier will always line up in the correct position with respect to the lower die shoe.

Looking now at FIGS. 11–14, the traveling vacuum box 44 is shown in detail. The vacuum box 44 is located on the lower die shoe 42. The lower die shoe also has a plurality of guide sleeves 148 fixed thereto. Guide posts 150 depending from the upper die shoe 40, slide in the sleeves 148 to maintain registration between the upper and lower tooling. The upper and lower die shoes also have stop blocks 152, which limit the downward motion of the die shoe 40. A plurality of tool holders or fixtures 154, which define the progressive work stations of the tooling, are fixed to the upper and lower die shoes.

Figures 11, 14:
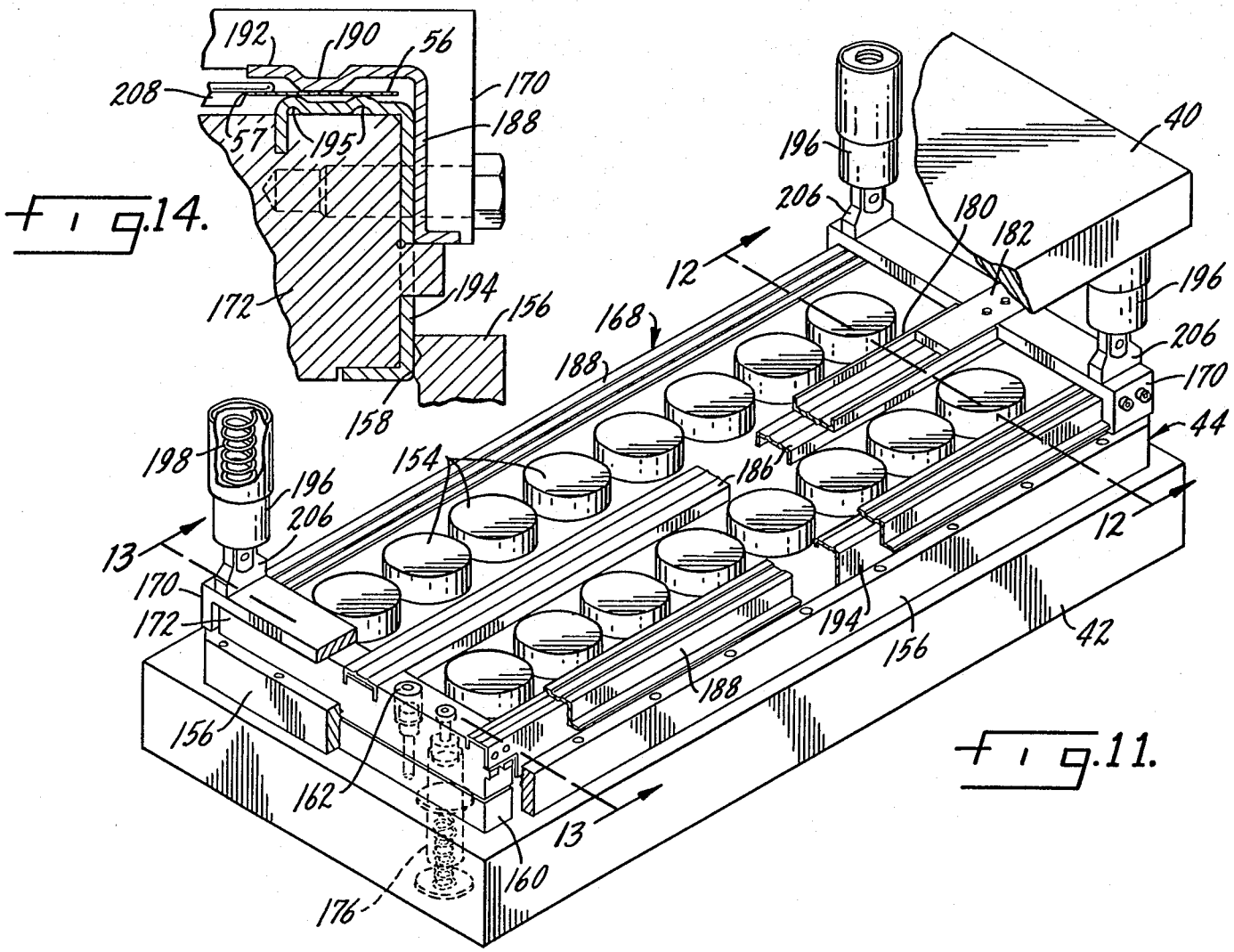
FIG. 11 is a diagrammatic perspective view of the vacuum box and associated apparatus.
FIG. 14 is a detail view showing the construction of the vacuum box frame.
Figure 12:
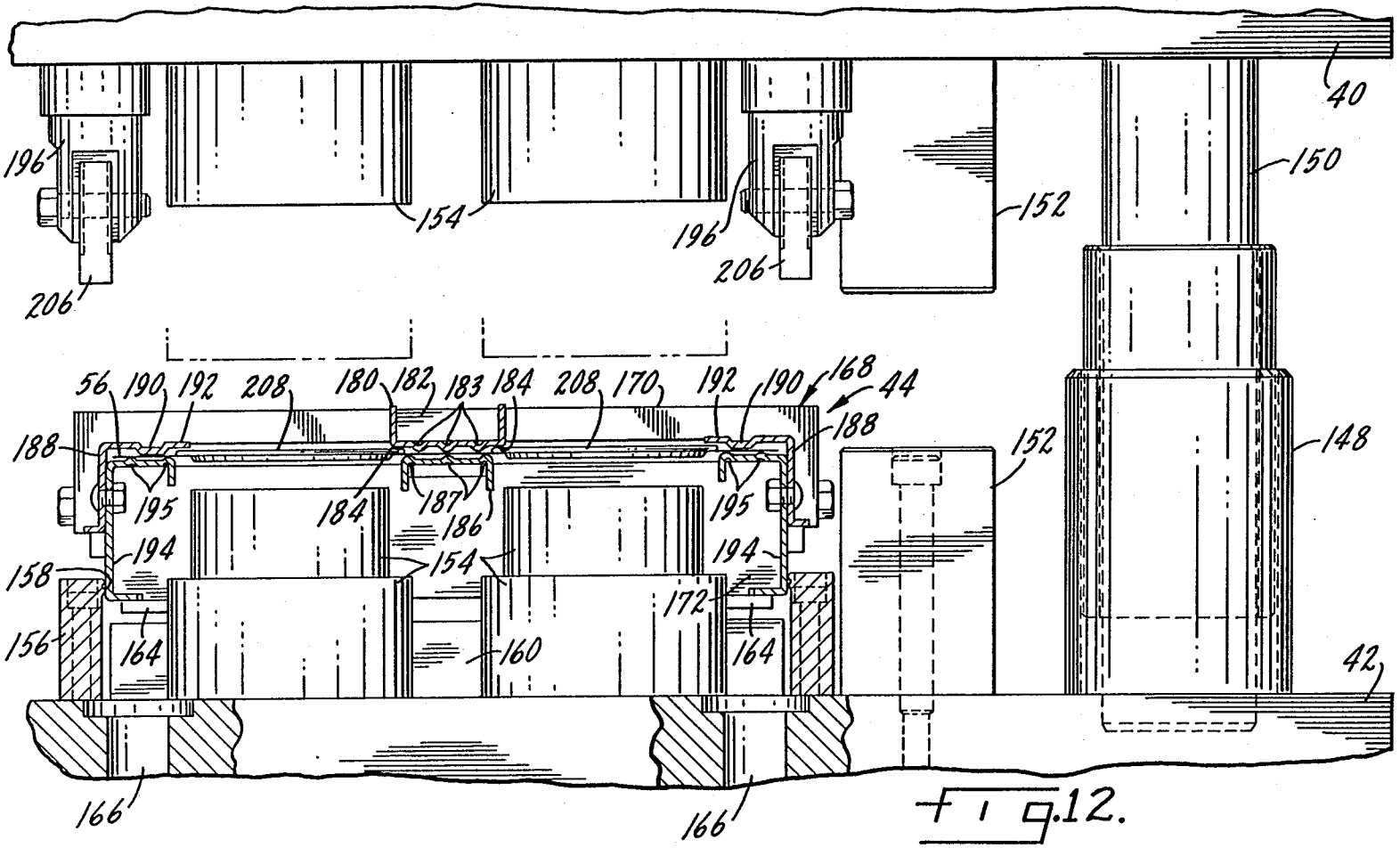
FIG. 12 is a section taken generally along line 12—12 of FIG. 11 with the ram in a raised position.
Figure 13:
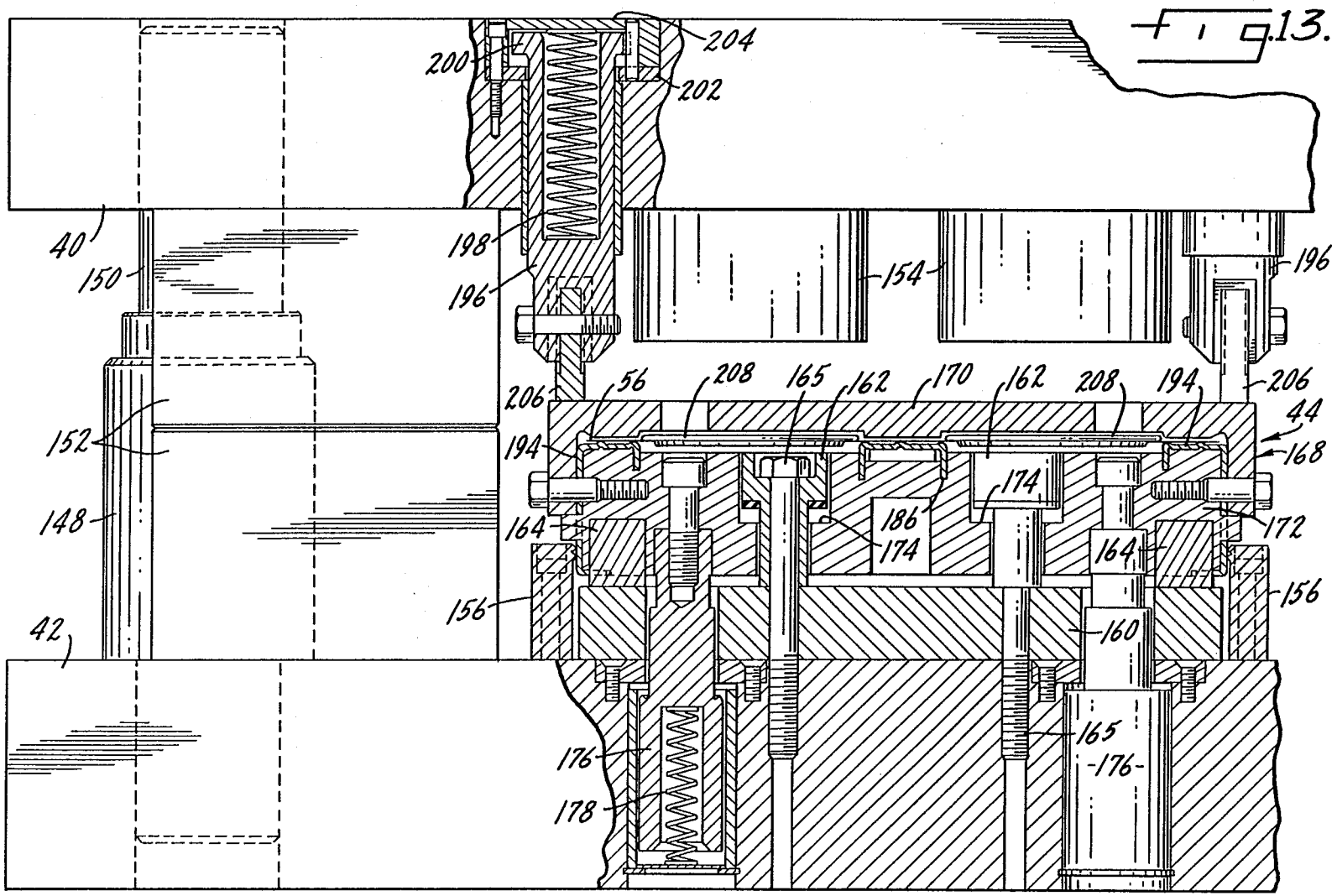
FIG. 13 is a section taken generally along line 13—13 of FIG. 11 with the ram in a lowered position.

The traveling vacuum box itself comprises an open-top case 156 bolted to the lower die shoe 42. The case surrounds the tool holders 154 of the work stations. The upper inside edge of the case has a seal element 158 (FIG. 14). The case also includes end blocks 160 (FIGS. 11 and 13). The end blocks mount stop members 162 and 164. Stops 162 may be retained by bolts 165. The interior of the case communicates with vacuum supply passages 166 (FIG. 12) formed in the die plate 42. These communicate with the vacuum ports 68 in the bolster.

The vacuum box also includes a traveling frame shown generally at 168. The ends of the frame are defined by belt lowering bars 170 on each end. The belt lowering bars have corner members through which bolts connect the bars to end support rails 172. The end support rails 172 have openings 174, which accommodate the stop members 162. The openings 174 and stops 162 cooperate to provide an up limit stop for the frame 168. The end support rails 172 are also bolted to spring-loaded frame supports 176. These supports extend through the blocks 160 into receptacles in the lower die shoe 42. Springs 178 bias the frame upwardly. There is a frame support 176 at each corner of the frame.

The belt lowering bars 170 and end support rails 172 are connected by three sets of rails, each having an upper and lower member. An upper center rail 180 is attached to the belt lowering bars 170, and located by a spacer 182. As best seen in FIG. 12 the upper center rail 180 has three central ribs 183, and corners 184. A lower center rail 186 is connected to the end support rails 172 and has dimples 187.

First and second sets of outer rails include a top outer rail 188, which is a generally Z-shaped part with its upper surface having a single rib 190 and a lip or flange 192. The top outer rails cooperate with lower outer rails 194, which are channel shaped members having a pair of dimples 195 on its upper edge. The ends of the lower outer rails are attached to the end support rails 172. It will be noted that the outside surfaces of the lower outer rails 194 engage the seals 158 of the case in sealing relation. Together the upper and lower outer rails 188 and 194 define tracks in which the forward run of the conveyor belt 56 travels.

The upper die shoe 40 has four sockets in which actuators 196 are placed. The actuators are biased downwardly by springs 198. The movement of the actuators within the socket is constrained by flanges 200, which are trapped between a stop 202 and a plate 204. The actuators have feet 206, which are engageable with the belt lowering bar 170 when the ram lowers the die shoe 40. The springs 198 have a higher spring rate than that of springs 178.

The operation of the vacuum box is as follows. The conveyor 56 is threaded through the three sets of rails in the vacuum box frame 168. That is, the lateral edges of the conveyor belt are held in the tracks formed by the upper and lower outer rails 188 and 194. In particular, the outer edges of the belt are held between the ribs 190 and dimples 195. This is best seen in FIG. 14. The center of the belt is trapped between center rails 180 and 186, and particularly between the ribs 183 and dimples 187. Thus, the conveyor belt 56 is constrained to travel with the frame of the vacuum box.

The shells are shown at 208. They rest in the openings 57 in the conveyor belt 56. The lateral edges of the shells are trapped between the belt on the underside, and the lips or flanges 192 of the outer rails, and the corners 184 of the center upper rail. Thus, the shells are positively held in place in the conveyor belt by the lips 192, and corners 184, as well as being held by the vacuum in the interior of the vacuum box 44.

During a downstroke of the ram, the upper die plate 40 carries the actuators 196 into engagement with the belt lowering bars 170. Since the actuator springs 198 are stiffer than the frame support springs 178, the actuators force the frame 168 downwardly until the stops 164 bottom on the blocks 160. As the frame travels down it carries the conveyor belt 56 with it, thereby carrying the shells into contact with the lower tools prior to the upper tools coming down on the shells. When the frame bottoms, the actuator springs 198 compress within the upper die shoe sockets to allow the ram to carry the upper tools to bottom dead center without damaging the vacuum box. Upon retraction of the ram, the tools leave contact with the shells first, and then the actuator stops 202 engage the flange 200 to lift the actuators off of the vacuum box frame. As the actuators rise, the frame also moves upwardly under the influence of its support springs 178 until slots 174 engage stops 162. Once the shells are out of contact with the lower tools, the conveyor belt indexes them forwardly to the next work station.

While a preferred form of the invention has been shown and described, it will be understood that alterations could be made thereto without departing from the scope of the following claims.

We claim:

1. A press for converting work pieces into parts, comprising a bed, a plurality of columns mounted on the bed having a way attached to each column, main drive means mounted on the columns, a ram slidable upon the ways and driven by the main drive means to reciprocate toward and away from the bed, upper and lower tooling means attached to the ram and bed, respectively, having a plurality of stations for processing said work pieces into parts, conveyor drive means mounted on the bed, and conveyor means mounted on the conveyor drive means for carrying work pieces into and through the tooling means stations, a feeder carrier mounted on a column opposite the tooling means and pivotable about a hinge line away from the tooling means to provide service access thereto, stock feed means mounted on the feeder carrier for feeding a strip stock into the stations of the tooling means, feeder drive means connected to the main drive means for driving said stock feed means, the feeder drive means including a drive shaft mounted coaxially with the hinge line so as to permit pivoting of the feeder carrier without disconnecting the feeder drive means from the stock feed means.

2. A press for converting work pieces into parts, comprising a bed, a plurality of columns mounted on the bed and having a way attached to each column, main drive means mounted on the columns, a ram slidable upon the ways and driven by the main drive means to reciprocate toward and away from the bed, upper and lower tooling means attached to the ram and bed, respectively, having a plurality of stations for processing said work pieces into parts, a feeder carrier mounted on a column opposite the tooling means and pivotable about a hinge line away from the tooling means to provide service access thereto, stock feed means mounted on the feeder carrier for feeding a strip stock into the stations of the tooling means, feeder drive means connected to the main drive means for driving said stock feed means, the feeder drive means being connected to the stock feed means through the hinge line so as to permit pivoting of the feeder carrier without disconnecting the feeder drive means from the stock feed means, the tooling means being arranged to extract work pieces from said stock and convert them into parts.

* * * * *